United States Patent [19]

Bier

[11] 3,968,189

[45] July 6, 1976

[54] METHOD AND APPARATUS FOR VARYING FUEL FLOW FROM A VARIABLE VENTURI CARBURETOR TO COMPENSATE FOR CHANGES IN BAROMETRIC PRESSURE AND ALTITUDE

[75] Inventor: Kenneth C. Bier, Bloomfield Hills, Mich.

[73] Assignee: Colt Industries Operating Corporation, New York, N.Y.

[22] Filed: Dec. 15, 1972

[21] Appl. No.: 315,325

[52] U.S. Cl. ..... 261/39 A; 261/72 R; 261/DIG. 56; 261/DIG. 67

[51] Int. Cl.[2] ..... F02M 7/24

[58] Field of Search..... 261/50 A, 39 A, DIG. 67, 261/DIG. 56, 62, 72 R

[56] References Cited

UNITED STATES PATENTS

| | | | |
|---|---|---|---|
| 1,740,917 | 12/1929 | Beck | 261/DIG. 67 |
| 2,216,677 | 10/1940 | Schuttler | 261/72 R |
| 3,322,408 | 5/1967 | Stoltman | 261/50 A |

FOREIGN PATENTS OR APPLICATIONS

| | | | |
|---|---|---|---|
| 109,099 | 8/1917 | United Kingdom | 261/39 A |

*Primary Examiner*—Travis S. McGehee
*Assistant Examiner*—Z. R. Bilinsky

[57] ABSTRACT

In a carburetor having an induction passage, a variable venturi in the induction passage, a fuel bowl and means for metering fuel flow from the fuel bowl to the induction passage, the method of compensating for changes in barometric pressure due to either atmospheric or altitude changes is disclosed as applying a vacuum or reduced pressure to the interior of the fuel bowl thereby reducing the fuel pressure which would otherwise exist, and causing a corresponding reduction in the mass rate of fuel flow in relation to the volume rate of air flow generally in accordance with a reduction in ambient pressure.

10 Claims, 2 Drawing Figures

METHOD AND APPARATUS FOR VARYING FUEL FLOW FROM A VARIABLE VENTURI CARBURETOR TO COMPENSATE FOR CHANGES IN BAROMETRIC PRESSURE AND ALTITUDE

APPARATUS

A carburetor having an induction passage with a variable venturi and a fuel bowl with a vent formed therein for communication with a source of ambient air has a valve member for controlling the flow of ambient air into the fuel bowl and variably restricted passage means for communicating to the interior of the fuel bowl a vacuum generated by air flowing past the variable venturi; with increasing altitudes or decreasing barometric pressure a bellows causes the valve to more nearly close-off the vent in order to have the interior of the fuel bowl more nearly approach the value of the vacuum generated at the variable venturi.

BACKGROUND OF THE INVENTION

It is well known in the art that the rate of fuel flow from a variable venturi carburetor fuel bowl, for any given size of fuel metering restriction employed, is dependent upon the pressure differential existing across the fuel within the bowl as measured, for example, from above the level of the fuel within the bowl to the discharge orifice of the fuel metering system.

Theoretically, in order to achieve a proper fuel-air mixture discharged by the carburetor, the relationship sought in one where a particular mass of fuel (such as pounds of fuel per hour) is metered as to be mixed with a particular mass of air (also such as pounds per hour).

In doing this, carburetors employ either a fixed or variable venturi, or some functionally equivalent structure, within the induction passage so that as air flows therethrough a reduction in the pressure (often referred to as venturi vecuum) of the air is achieved in the vicinity of the venturi throat. The value of the venturi vacuum is of a variable magnitude generally indicative of the rate of flow of such air through the venturi.

However, the flow of air through such venturi does not necessarily indicate that the mass rate of flow of such air is constant even though the venturi vacuum generated thereby should remain constant. That is, the generated venturi vacuum is produced in response to the volume rate of air flow and not the mass rate of air flow. Consequently, as either barometric pressure changes due to atmospheric conditions or ambient pressures change due to changes in altitude, the volume rate of air flow many in fact remain constant but such a volume rate of air flow will represent differing values of mass rate of air flow as between two different atmospheric pressures. For example, while driving through the mountains a volume rate of flow of air developing the same venturi vacuum as previously experienced at, for example, sea level, will actually represent a lesser mass rate of flow of air because of the decrease in density of the air in such higher altitudes. However, since the rate of metered fuel flow is primarily dependent on the vacuum generated at the venturi (and consequent pressure differential across the fuel in the fuel bowl) substantially the same rate of fuel flow is metered to the less dense air of the higher altitude as was metered to the more dense air of the lower altitude.

Obviously, at times, the above results in a somewhat overrich (in terms of fuel) fuel-air mixture delivered to the engine, which, in turn, to that degree increases engine exhaust emissions.

The above problems have been known in the prior art and heretofore attempts have been made to compensate fuel metering requirements in respect to changes in barometric pressure or altitude. Such prior art attempts have taken the form of, for example, a bellows employed for varying the effective area of a restriction used to meter the fuel flow. The determination of such effective area was accomplished as by a variably positioned metering rod cooperating with a fixed orifice. However, such arrangements have not been accepted for various reasons among which are the difficulty of manufacturing the metering rod to the extremely close tolerances required, the accurate and positive location of the metering rod with respect to the surface defining the cooperating fixed orifice and maintaining such relationship during movement of the metering rod, the rather limited travel of the metering rod in which the entire spectrum of compensation must be achieved, and the propensity for such systems to become impaired by virtue of particles of dirt especially when the effective area of the metering orifice is reduced.

Accordingly, the invention as herein disclosed and claimed is primarily directed to the solution of the above as well as other attendant problems.

SUMMARY OF THE INVENTION

According to the invention, a method of controlling the rate of metered fuel flow in an internal combustion engine carburetor having a body, induction passage means formed through said body for communicating with said engine, variable venturi means situated within said induction passage means, fuel reservoir means for containing fuel, fuel delivery means including fuel metering means communicating between the interior of said fuel reservoir means and said induction passage means, said fuel metring means being effective to meter the rate of fuel flow from said fuel reservoir means through said fuel delivery means and into said induction passage means in accordance with a metering pressure differential across said metering means, comprises the steps of sensing a pressure indicative of ambient pressure, sensing a pressure indicative of the volume rate of air flow through said induction passage means, modifying the said pressure indicative of the volume rate of air flow in accordance with the degree to which said variable venturi means is opened, and creating a control pressure within said fuel reservoir applied against said fuel which is a function of both said pressure indicative of ambient pressure and said modified pressure indicative of rate of air flow in order to reduce the magnitude of said metering pressure differential to compensate for decreases in ambient pressure.

Apparatus for carrying out the above inventive method may be described as a carburetor for an internal combustion engine comprising a carburetor body, induction passage means formed through said body for communication with said engine, variable venturi means situated in said induction passage means effective for defining a variably openable venturi throat, fuel reservoir means for containing fuel, fuel supply means communicating between the interior of said fuel reservoir means and said induction passage means, fuel metering restriction means associated with said fuel supply means for metering the rate of fuel flow from said fuel reservoir means through said fuel supply means and into said induction passage means and additional means responsive partly to the degree of opening of said variable venturi throat effective for creating a variable pressure within said fuel reservoir means and against the fuel contained therein, said additional means being effective to reduce the magnitude of said variable pressure in order to reduce the rate of metered fuel flow through said fuel metering restriction means and thereby compensate for attendant reduction in ambient pressure.

Various general and specific objects and advantages of the invention will become apparent when reference is made to the following detailed written description considered in conjunction with the accompanying drawings.

BRIEF DESCRIPTION OF THE DRAWINGS

In the drawings, wherein for purposes of clarity certain details and elements may be omitted.

DESCRIPTION OF THE PREFERRED EMBODIMENTS

Figure 1:
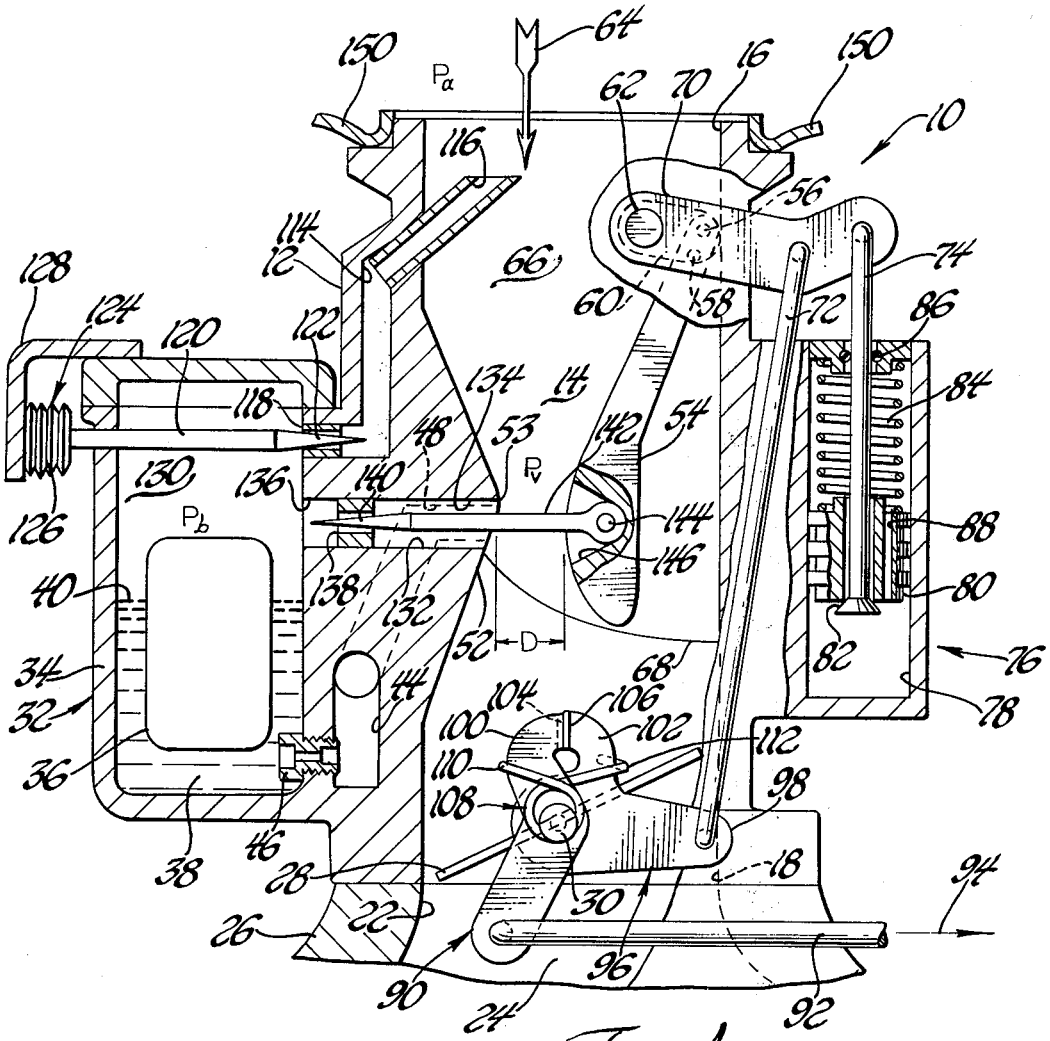
FIG. 1 illustrates, in cross-section, a variable venturi carburetor constructed in accordance with the teachings of the invention.

Referring now in greater detail to the drawings, FIG. 1 illustrates a carburetor assembly 10 having body or housing means 12 with an induction passage 14 formed therethrough with such induction passage 14 having an air inlet end 16 and an outlet or discharge end 18 leading to an inlet 22 of the interior 24 of an intake manifold 26 of an associated internal combustion engine. A variably positionable throttle valve 28, mounted as for pivotal rotation on a throttle shaft 30, is situated within the induction passage and effective for controlling the flow of a motive or combustible mixture from said induction passage 14 into the intake passage 24 of engine manifold 26. Generally, such combustible mixture will, of course, be comprised of atmosphereic air admitted into inlet end 16 and fuel supplied to the induction passage 14 from an associated fuel reservoir of fuel bowl assmbly 32.

The fuel bowl assembly 32 is illustrated as comprising a suitable bowl or housing structure 34 which may contain a float member 36 controlling an associated fuel inlet needle valve assembly (not shown but well known in the art) so as to maintain the level of the fuel 38 within the bowl 34 at a preselected level as at 40.

The related fuel metering means is shown as comprising a fuel well conduit 44 with the lower end thereof being in communication with the fuel 38 via calibrated restriction means 46. Conduit 44 leads to a fuel discharge conduit or nozzle-like portion 48 which communicates with the induction passage 14 as at an outlet or discharge orifice 50. Preferably, the discharge orifice 50 is located as to be just below or down-stream of the throat of a variable venturi arrangement as by having such opening formed in the fixed wall or fixed half 52 of the variable venturi.

As illustrated, the variable venturi may be comprised of a variably positionable venturi plate 54 which may be fixedly secured as by fasteners 56, 58 to an internally disposed arm 60 which, in turn, is fixedly secured to a rotatable shaft 62 journalled in the housing means 12. The venturi arrangement may be such as to define a generally rectangular opening at the throat of the variable venturi when viewed, for example, in the direction of arrow 64. In fact, opposite walls, one of which is shown at 66, may define flat planar surfaces permitting the variable or moveable venturi plate 54 to be closely received therebetween for swingable motion about the centerline of rod or shaft 62. Such flat planar surfaces would terminate as at a boundary line 68 from which the portion of the induction passage means 14 downstream thereof would transtionally change configuration until it became circular to accommodate the throttle valve 28.

A second lever 70 is fixedly secured at one end to shaft 62, for rotation therewith, and has its swingable arm portion connected as to linkage rods 72 and 74. Rod 74 comprises a portion of a dashpot assembly 76 which is illustrated as having an internal cylindrical chamber 78 containing therein a suitable fluid and a slideable piston member 80 through which the rod 74 freely extends as to be abuttably engageable therewith at its lower portion 82. A compression spring 84 also contained within chamber 78 continually resiliently urges piston 80 downwardly. suitable sealing means such as at 86 may be provided for preventing the escape of damping fluid from chamber 78. Generally, as piston 80 is moved upwardly by rod 74, the fluid is chamber 78 above the piston 80 is forced to a position below the piston 80. This may be done as by calibrated bleed means 88 formed through piston 80 or any other such equivalent means well known in the art.

A lever 90 suitably fixedly secured to throttle shaft 30, for rotation therewith, is operatively connected to motion transmittidng linkage means 92 leading to, for example, the usual vehicle operator foot-controlled throttle pedal (not shown) so that when moved in the direction of arrow 94 the throttle valve 28 is moved counter-clockwise in the opening direction about the centerline of throttle shaft 30.

A second lever 96 mounted on throttle shaft 30 in a manner permitting free relative motion with respect to and about shaft 30, has an arm portion 98 pivotally connected to linkage 72. Levers 90 and 96, in turn, respectively have arm portions 100 and 102 which carry generally transversely extending abutment portions 104 and 106. A torsion spring 108, having its main coil generally about shaft 30, has its arms 110 and 112 operatively respectively engaged with lever arm portions 100 and 102 as to thereby normally resiliently maintain abutments 104 and 106 engaged with each other resulting in unitary motion of levers 90 and 96.

Suitable vent passage means 114, having a first end 116 communicating with a source of ambient atmospheric pressure, has its other end, which may include a calibrated and suitably contoured valve seat portion 118, communicating with the interior of the fuel bowl 34. A needle-like valve member 120, illustrated as being suitably guided as within a portion of the fuel bowl body 34, has a contoured metering surface 122 for cooperation with the seat or calibrated passage means 118. Altitude responsive means, such as an evacuated bellows 124 having body means 126 resiliently urged toward a direction of elongation, is suitably secured to the end of valve member 120 and to a related support 128 fixedly carried as by the fuel bowl 34. Generally, as altitude increases and therefore the value of atmospheric pressure decreases, bellows 124 will move valve 120 toward the right causing the valving portion 122 to more nearly close flow through 118 or, in other words, to increasingly restrict the communication from conduit means 114 through passage means 118 and into interior chamber 130 of the fuel bowl 34 above the level 40 of fuel 38.

Additional conduit means 132 is illustrated as having one end 134 communicating with induction passage 14 preferably at a point immediately downstream of the throat portion 53 of fixed venturi section 52. Another end 136 of conduit means 132 is in communication with the interior chamber 130 of fuel bowl or reservoir 34 above the normal level 40 of the fuel 38 carried therein. Calibrated passage means 138, provided in conduit means 132, may be suitably contoured so as to cooperate with a contoured metering portion 140 of needle-like valve member 142 which may be pivotally secured as by a pivot member 144 to the moveable venturi plate 54 as within a recess 146 formed therein.

OPERATION OF THE INVENTION

It is well known that the rate of fuel flow from the fuel bowl 34, for any given size of fuel metering restriction employed, is dependent upon the pressure differential existing across the fuel within the bowl as measured, for example, from above the level of the fuel within the bowl to discharge orifice 50.

Theoretically, in order to achieve a proper fuel-air mixture discharged by the carburetor, the relationship sought is one where a particular mass of fuel (such as pounds of fuel per hour) is metered as to be mixed with a particular mass of air (also such as pounds of air per hour).

In doing this, carburetors employ either a fixed or variable venturi, or some such functionally equivalent structure, such as venturi section 52 and moveable venturi plate 54, within the induction passage so that as air flows therethrough a reduction in the pressure (often referred to as venturi vacuum) of the air is achieved in the vicinity of the venturi throat. The value of the venturi vacuum is of a variable magnitude generally indicative of the rate of flow of such air through the venturi.

However, the flow of air through such venturi does not necessarily indicate that the mass rate of flow of such air is constant even though the venturi vacuum generated thereby should remain constant. That is, the generated venturi vacuum is produced in response to the volume rate of air flow and not the mass rate of air flow. Consequently, as either barometric pressure changes due to changes in altitude, the volume rate of air flow may in-fact remain constant but such volume rate of air flow will represent differing values of mass rate of air flow because of the change in the density of the air.

Therefore, it should be apparent that if two different altitudes or ambient pressures are considered, that at the reduced ambient pressure the fuel-air mixture discharged into the engine will be richer (in terms of fuel) than at the relatively greater ambient pressure for the same volume rate of air flow through the induction passage. However, a problem, somewhat peculiar to variable venturi carburetors, exists and may best be understood by a comparative reference to carburetors employing fixed venturii.

For example, in fixed venturi carburetors, the venturi vacuum or reduced pressure generated at the venturi throat is actually dependent on the velocity of flow of air through such venturi throat. However, because of the fact that the venturi throat is of a premanently fixed dimension (and therefore of a fixed flow area), such rate of flow of air is usually referred to in terms of a volume rate of flow because the rate of flow of air described in either terms of volume rate of flow or velocity rate of flow is the same since velocity and volume are directly related.

However, in a variable venturi carburetor, the venturi throat flow area is variable in accordance with the variable dimension, D. Therefore, the velocity rate of flow of air through the venturi throat is not directly related to the volume rate of flow of air at all positions of the moveable venturi plate 54.

Therefore, where in a carburetor of a fixed venturi the generated venturi vacuum is proportional to the square of the volume rate of air flow through induction passage, in a carburetor having a variable venturi, no such relationship exists because the size of the variable venturi throat is variable. In a variable venturi carburetor, generally, the moveable venturi plate 54 is placed at the closest distance away from the fixed venturi section 52 during curb idle engine operation to thereby create a metering vacuum sufficient to cause metered fuel flow into the induction passage even though volume rate of air flow at this condition of engine operation is, relatively, very small. By closely spacing the moveable venturi plate 52, the small volume rate of air flow during curb idle is caused to sufficinetly accelerate through the venturi throat resulting in the necessary venturi vacuum being generated.

Let it now be assumed that the associated engine is in operation at sea level and let it be further assumed, for purposes of discussion, that the engine is operating with the throttle valve 28 moved from its curb idle position to some partly open "part throttle" position.

At this condition of sea-level operation, maximum ambient pressure will be applied to bellows 124 causing it to shorten and to that degree move valve member 120 away from vent passage means 118 thereby permitting the maximum degree of communication, for the then existing barometric pressure, between the interior of fuel bowl 34 and the ambient atmosphere. For purposes of reference, the pressure within fuel bowl 34 may be desgnated $P_b$, while the ambient atmosphere is designated $P_a$. In the present assumed condition, $P_b$ will be equal to $P_a$. Further, the pressure produced by the flow of air through the venturi throat, and existing in conduit 132, will be referred to as $P_v$. As will be seen pressure $P_b$ is always greater than pressure $P_v$.

Under the above assumed conditions, it should be apparent that because of the lower magnitude of pressure $P_v$ air flow will occur from above the fuel within fuel bowl 34 through conduit 132. However, because of restriction of cooperating means 138 and 140 and the fact that maximum communication exists through vent means 118, the value of pressure $P_b$ will remain constant and not be influenced by such flow through conduit 132. Accordingly, at this time a fuel metering pressure of $\Delta P_1$ ($\Delta P_1 = P_b - P_v$) will exist causing fuel to be metered, at a predetermined rate of flow, through the main metering restriction 46 and ultimately discharged from the fuel nozzle 48. Such rate of metered fuel flow is, of course, related to the then volume rate of flow of air through the variable venturi throat and the induction passage 14.

Now, for comparison, let it be assumed that the engine is placed to operate at either a higher altitude or is subjected to a lower barometric pressure (in either event, being at a lower ambient pressure). Let it also be assumed that the exact same volume rate of flow of air through induction passage 14 is maintained as by maintaining the throttle valve and variable venturi plate 54 is the same position as at sea level. However, from the preceding it is known that at such a reduced ambient pressure, the density of the air flowing through the carburetor is reduced and therefore ideally the rate of flow of fuel should be compensated in respect to the change in ambient pressure. This is accomplished in the following manner.

As the ambient pressure $P_a$ decreases to a value $P_{a-1}$, bellows 124 elongates causing valving or metering portion 122 of valve member 120 to generally correspondingly restrict the communication, otherwise generally free, through vent means 118. Consequently, the interior of the fuel bowl 34 is placed as a chamber in series with and between restricted passage means in a flow through system. Therefore, the value of the resulting pressure in the fuel bowl, $P_{B-1}$, becomes somewhat less than the then existing ambient pressure $P_{a-1}$ but greater than pressure $P_v$. The new fuel metering pressure, $\Delta P_2$, ($\Delta P_2 = P_{b-1} - P_v$) then becomes less than the fuel metering pressure $\Delta P_1$ existing at higher ambient pressures. As a result of the reduction in magnitude of the metering pressure, a reduced rate of flow of fuel is realized and the described ratio of the resulting fuel-air mixture discharged by the carburetor is maintained regardless of changes in the ambient pressure.

As should be apparent, the source of the atmospheric pressure vented to the interior of the fuel bowl through the valved vent means 118, 114 may be any suitable source and need not necessarily be the interior of the intake or air horn section of the carburetor, as illustrated, communicating with the interior of an associated air cleaner assembly fragmentarily illustrated at 150. For example, the vent means 118, 114, especially in present vehicles, may acquire its ambient atmospheric pressure signal through intermediary type means such as, an engine crankcase (which has various conduitry associated therewith, as for example, the present PCV systems), directly with the ambient atmosphere as by means of valved venting means formed through an external wall of the fuel bowl, or any other such available locations, as well as combinations thereof, since all of such locations accurately convey indicia of ambient pressures.

In view of the preceding, it can be seen that the pressure, $P_b$, within the fuel bowl, at any particular condition of engine operation is:

a. a function of the ambient pressure (whether due to barometric pressure change or change in altitude) which controls the effective size of fuel bowl venting means, and b. is a function of the velocity rate of air flow through the variable venturi throat (which for any particular chosen effective area can be expressed in terms of volume rate of air flow) which determines the pressure, $P_v$, at the throat of the variable venturi.

Mechanically, the operation of the carburetor 10 is briefly as follows. As throttle valve 28 is rotated counter-clockwise in the opening direction, spring 108 causes lever 96 to, in unison, rotate counterclockwise with throttle lever 90 and, in turn, through linkage 72, causes lever 70 and moveable venturi plate 54 to also correspondingly rotate counter-clockwise about the axis of shaft or pivot 62. In so doing valve 142 is progressively moved generally toward the right resulting in the contoured metering portion 140 to move away from the cooperating valving seat member 138 thereby providing for greater communication as between fuel bowl chamber 130 and the variable venturi throat. Generally, in view of the above, it can be seen that as the throttle valve 28 is opened in response to increased engine loads the moveable variable venturi plate 54 is also moved causing dimension D to increase.

The dashpot means 76 is provided in order to prevent an excessively rapid opening movement of moveable venturi plate 54. For example, if linkage 92 should be rapidly moved toward a fully opened ("wide open throttle") position, the upward movement of linkage 72 will be resisted and opposed by the fluid in chamber 78 above piston 80. As a consequence of such opposition to movement, the abutment portions 104 and 106 of levers 90 and 96 part against the resilient force of spring 108 which continues to resiliently urge levers back to a relative relationship as depicted. As a result, during such periods of rapid opening of the throttle valve, the rate of movement of the moveable venturi plate 54 is purposely retarded thereby assuring for a smooth transition in the velocity rate of air flow through the venturi throat and preventing a possible loss of metering pressure due to a sudden rapid opening of the variable venturi throat.

Figure 2:
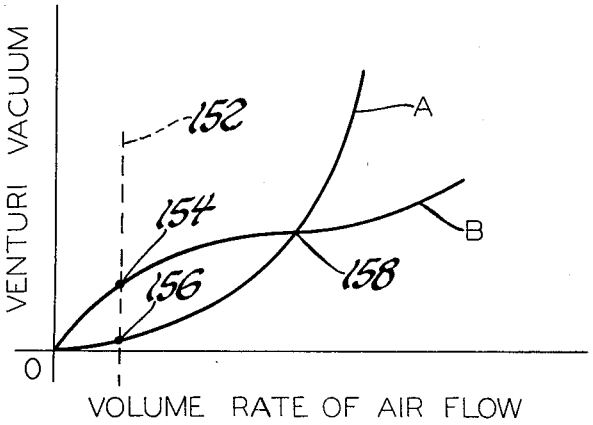
FIG. 2 is a graph illustrating characteristic venturi vacuum curves generated by typical fixed venturi and variable venturi carburetors.

FIG. 2 graphically depicts the characteristic curves developed by plotting the generated venturi vacuum against the volume rate of air flow in each of the fixed venturi type carburetor and variable venturi type carburetor. Curve A represents the curve characteristically developed in the fixed venturi carburetor while curve B represents the curve characteristically developed in the variable venturi carburetor.

For an inspection of the graph of FIG. 2, it can be seen that curves A and B both originate from the zero point and intersect at a point 158. Further, if vertical dash-line 152 is assumed to represent a typical air flow for a particular engine at curb-idle operation, it can be seen that line 152 intersects curves B and A respectively at points 154 and 156 and that point 154 represents a substantially greater magnitude of generated venturi vacuum than that represented by point 156. It is also apparent that for all values of air flow between line 152 and point 158, curve B represents venturi vacuum values greater than those vacuum values represented by the corresponding portion of curve A.

Consequently, in order to in effect reduce the magnitude of the venturi vacuum generated in the variable venturi of the invention and thereby effectively lower and shape the portion of the curve between points 154 and 158, as far as its effect within the fuel bowl chamber 130 is concerned, the metering type valving means 138 and 140 are provided with surface 150 being carried by valving member 142 positioned by venturi plate 54.

Generally, the closer that venturi plate 54 is to venturi section 52 the greater will be the restriction to communication between fuel bowl chamber 130 and orifice 134 through metering means 138, 140. This, of course, means that the effect of the actual vacuum generated at the venturi throat is to that degree diminished. As a consequence thereof, the resulting vacuum or pressure (due to the venturi vacuum) permitted to provide an influence upon the metering pressure within the fuel bowl chamber 130 is made indicative and relative to the actual volume rate of air flow through the induction passage 14.

Although only one preferred embodiment of the invention has been disclosed and described, it is apparent that other embodiments and modifications of the invention are possible within the scope of the appended claims.

I claim:

1. A method of controlling the rate of metering fuel flow in an internal combustion engine carburetor having a body, induction passage means formed through said body for communicating with said engine, fuel reservoir means for containing fuel, variable venturi means situated within said induction passage means, throttle valve means situated within said induction passage means downstream from said variable venturi means, fuel delivery means including fuel metering means communicating between the interior of said fuel reservoir means and said induction passage means adjacent said venturi, said fuel metering means being effective to meter the rate of fuel flow from said fuel reservoir means through said fuel delivery means and into said induction passage means in accordance with a metering pressure differential across said metering means, said method comprising the steps of sensing a pressure indicative of ambient pressure, sensing a pressure indicative of the velocity rate of air flow through said induction passage means, modifying the said pressure indicative of the velocity rate of air flow in accordance with the degree to which said variable venturi means is opened, and creating a control pressure within said fuel reservoir applied said fuel which is a function of both said pressure indicative of ambient pressure and said modified pressure indicative of rate of air flow in order to reduce the magnitude of said metering pressure differential to compensate for decreases in ambient pressure.

2. A method according to claim 1 wherein said step of sensing a pressure indicative of the velocity rate of air flow includes the step of causing said modified pressure to vary in proportion to the mathematical square of the volume rate of air flow.

3. A method according to claim 1 wherein the step of creating said control pressure includes the steps of creating a first pressure flow from a source of ambient pressure to said fuel reservoir, creating a second pressure flow from said fuel reservoir to said induction passage means, and regulating the rate of flow of said first pressure flow as to cause said control pressure to have a magnitude less than said ambient pressure but greater than said pressure indicative of the said velocity rate of air flow.

4. A carburetor for an internal combustion engine, comprising a carburetor body, induction passage means formed through said body for communication with said engine, variable venturi means situated in said induction passage means effective for defining a variably openable venturi throat, throttle valve means situated in said induction passage downstream from said venturi, fuel reservoir means for containing fuel, fuel supply means communicating between the interior of said fuel reservoir means and said induction passage means adjacent said venturi, fuel metering restriction means associated with said fuel supply means for metering the rate of fuel flow from said fuel reservoir means through said fuel supply means and into said induction passage means, and additional means responsive to the degree of opening of said variable venturi throat and effectve for creating a variable pressure within reservoir means and against the fuel contained therein, said additional means communicating with said induction passage adjacent said venturi throat so as to sense a vacuum which is indicative of the velocity rate of air flow through said venturi means, said additional means being effective to reduce the magnitude of said variable pressure in order to reduce the rate of metered fuel flow through said fuel metering restriction means and compensate for attendant reduction in ambient pressure.

5. A carburetor according to claim 4 wherein said additional means comprises first means for producing a first pressure indicative of said velocity rate of air flow through said induction passage means, second means responsive to the magnitude of ambient pressure for in accordance therewith variably restrictively completing communication between the interior of said fuel reservoir means above said fuel contained therein and a source of ambient pressure, and further means for modifying the magnitude of said first pressure indicative of said velocity rate of air flow and permitting such modified pressure to exert an influence in said interior of said reservoir means thereby creating said variable pressure.

6. A carburetor for an internal combustion engine, comprising a carburetor body, induction passage means formed through said body for communication with said engine, variable venturi means situated in said induction passage means effective for defining a variably openable venturi throat, fuel reservoir means for containing fuel, fuel supply means communicating between the interior of said fuel reservoir means and said induction passage means, fuel metering restriction means associated with said fuel supply means for metering the rate of fuel flow from said fuel reservoir means through said fuel supply means and into said induction passage means, and additional means responsive partly to the degree of opening of said variable venturi throat effective for creating a variable pressure within said fuel reservoir means and against the fuel contained therein, said additional means being effective to reduce the magnitude of said variable pressure in order to reduce the rate of metered fuel flow through said fuel metering restriction means and thereby compensate for attendant reduction in ambient pressure, said additional means comprising first means for producing a first pressure indicative of the velocity rate of air flow through said induction passage means, second means responsive to the magnitude of ambient pressure for in accordance therewith variably restrively completing communication between the interior of said fuel reservoir means above said fuel contained therein and a source of ambient pressure, and further means for modifying the magnitude of said first pressure indicative of said velocity rate of air flow and permitting such modified pressure to exert an influence in said interior of said reservoir means thereby creating said variable pressure, and further means comprising passage means communicating between a source of said first pressure indicative of said velocity rate of air flow through said induction passage means and said interior of said fuel reservoir means at an elevation above the normal level of said fuel contained within said fuel reservoir means, and metering valving means for variably restricting the degree of communication through said passage means generally in accordance with the degree of opening of said variable venturi throat.

7. A carburetor according to claim 5 wherein said further means comprises valve-controlled passage means communicating between a source of said first pressure indicative of said velocity rate of air flow through said induction passage means and said interior of said fuel reservoir means at an elevation above the normal level of said fuel contained within said fuel reservoir means, and wherein said valve-controlled passage means communicates with said source of said first pressure at a point in said induction passage means downstream of said variable venturi throat.

8. A carburetor according to claim 7 wherein said second means responsive to the magnitude of ambient pressure comprises venting means communicating with said interior of said fuel reservoir means, valving means for regulating the effective flow area of said venting means, and ambient pressure responsive means operatively connected to said valving means for positioning said valving means in response to the magnitude of said ambient pressure.

9. A carburetor according to claim 8 wherein said ambient pressure responsive means comprises at least partially evacuated bellows means.

10. A carburetor for an internal combustion engine, comprising a carburetor body, induction passage means formed through said body for communication with said engine, variable venturi means situated in said induction passage means effective for defining a variably openable venturi throat, fuel reservoir means for containing fuel, fuel supply means communicating between the interior of said fuel reservoir means and said induction passage means, fuel metering restriction means associated with said fuel supply means for metering the rate of fuel flow from said fuel reservoir means through said fuel supply means and into said induction passage means, and additional means responsive partly to the degree of opening of said variable venturi float effective for creating a variable pressure within said fuel reservoir means and against the fuel contained therein, said additional means being effective to reduce the magnitude of said variable pressure in order to reduce the rate of metering fuel flow through said fuel metering restriction means and thereby compensate for attendant reduction in ambient pressure, said additional means comprising first means for producing a first pressure indicative of the velocity rate of air flow through said induction passage means, second means responsive to the magnitude of ambient pressure for in accordance therewith variably restrictively completing communication between the interior of said fuel reservoir means above said fuel contained therein and a source of ambient pressure, and further means for modifying the magnitude of said first pressure indicative of said velocity rate of air flow and permitting such modified pressure to exert an influence in said interior of said reservoir means thereby creating said variable pressure, said further means comprising variably positionable metering valve means operatively positionable by said variable venturi in response to changes in the degree of opening of said variable venturi throat.

* * * * *